US009827505B2

(12) United States Patent
Najar

(10) Patent No.: US 9,827,505 B2
(45) Date of Patent: Nov. 28, 2017

(54) SWING ATTACHMENT APPARATUS

(71) Applicant: Sarah Elizabeth Najar, Grand Rapids, MI (US)

(72) Inventor: Sarah Elizabeth Najar, Grand Rapids, MI (US)

( * ) Notice: Subject to any disclaimer, the term of this patent is extended or adjusted under 35 U.S.C. 154(b) by 0 days.

(21) Appl. No.: 15/429,602

(22) Filed: Feb. 10, 2017

(65) Prior Publication Data

US 2017/0225085 A1 Aug. 10, 2017

Related U.S. Application Data

(60) Provisional application No. 62/293,394, filed on Feb. 10, 2016.

(51) Int. Cl.

| | |
|---|---|
| ***A63G 9/00*** | (2006.01) |
| ***A63H 3/36*** | (2006.01) |
| ***A63H 3/02*** | (2006.01) |
| ***A63H 3/50*** | (2006.01) |
| *A47D 13/00* | (2006.01) |

(52) U.S. Cl.

CPC ..... *A63H 3/36* (2013.01); *A63G 9/00* (2013.01); *A63H 3/02* (2013.01); *A63H 3/50* (2013.01)

(58) Field of Classification Search

CPC . A63G 9/00; A63G 9/16; A47D 13/00; A47D 13/02; A47D 13/025; A47C 1/023; A47C 7/021

USPC ..... 472/118–125; 297/51, 92–93, 230.1, 297/301.1, 301.7, 383

See application file for complete search history.

(56) References Cited

U.S. PATENT DOCUMENTS

| | | | | |
|---|---|---|---|---|
| 2,555,566 | A * | 6/1951 | Bleck | A47D 1/103 297/152 |
| 4,382,595 | A * | 5/1983 | Tolar | A63G 9/00 297/275 |
| 6,520,862 | B1 * | 2/2003 | Armbruster | A47D 13/105 472/118 |
| 6,921,135 | B2 * | 7/2005 | Ellis | A47C 1/023 297/344.18 |
| 7,175,535 | B1 * | 2/2007 | Marmentini | A47D 13/025 297/273 |
| 7,578,746 | B1 * | 8/2009 | Johnson | A63H 33/006 297/485 |
| 7,931,339 | B1 * | 4/2011 | Stocker | A47C 7/021 297/328 |
| 8,083,600 | B2 * | 12/2011 | Sheets | A63G 9/00 297/273 |
| 2011/0266847 | A1 * | 11/2011 | Bertolini | A47C 7/445 297/239 |

* cited by examiner

*Primary Examiner* — Kien Nguyen

(74) *Attorney, Agent, or Firm* — Gardner, Linn, Burkhart & Flory, LLP

(57) ABSTRACT

A swing attachment apparatus for holding a child's toy on a swing includes a seat base that has a lower portion configured to rest on a swing seat and an upper portion configured to support a child's toy. A seat back may be provided that adjustably engages with the seat base to support a rear portion of the child's toy. A first strap is attached to the seat base and is configured to wrap around the swing seat to secure the seat base to the swing. A second strap is attached to the seat base and is configured to extend over the child's toy to secure the child's toy between the second strap and the seat base.

20 Claims, 11 Drawing Sheets

SWING ATTACHMENT APPARATUS

CROSS REFERENCE TO RELATED APPLICATION

The present application claims the filing benefit of U.S. provisional application, Ser. No. 62/293,394, filed Feb. 10, 2016, which is hereby incorporated herein by reference in its entirety.

FIELD OF THE INVENTION

The present invention relates generally to a swing set attachment, and more particularly to a device that attaches to a swing of a swing set for holding a child's toy.

BACKGROUND OF THE INVENTION

A child's stuffed toy may be a very important belonging that the child carries anywhere they go. However, there are activities that a child generally cannot participate in with such a toy, such as swinging on a swing set. As generally understood, swing sets typically have swing seats that are supported by ropes or chains, which a user will grasp while swinging. It is the object of the present invention to allow for a child's stuffed toy to play along with the child on a swing set.

SUMMARY OF THE INVENTION

The present invention provides a swing attachment apparatus for a user, such as a child, to attach to an existing swing set to use as a seat for a child to place and secure their toy, such as a doll or stuffed animal or the like. The swing attachment apparatus includes a toy seat that has a seat base and a seat back, where the seat base is secured to the swing seat, such as a rigid seat, flexible seat, or tire, or the like. The seat back may be removably and/or adjustably attached to the seat base to allow the seat back to be positioned relative to seat base in a manner that adjusts the seating area to accommodate toys of different sizes and shapes. Such adjustment of the seat back may also allow the toy to be positioned on the seat base in a location that generally centers the toy's center of gravity over the swing seat, such that the toy remains generally upright and does not flip over or upside-down due to the unsupported weight of the toy, when secured to the swing attachment apparatus. The toy seat and toy may be secured to the swing seat with attachment devices, such as straps or belts or the like, that secure the toy in a manner that generally allows a child to swing and play with the toy without it being dislodged. The seat base and seat back may preferably be made of thin durable plastic material and the straps may preferably be made using nylon material or the like.

In accordance with one aspect of the present invention, a swing attachment apparatus for holding a child's toy on a swing includes a seat base that has a lower portion configured to rest on a swing seat and an upper portion configured to support the child's toy. A first strap is attached to the seat base and is configured to wrap around the swing seat to secure the seat base to the swing. A second strap is also attached to the seat base and is configured to extend over the child's toy to secure the child's toy between the second strap and the seat base. A seat back may be adjustably engaged with the seat base and configured to support a rear portion of the child's toy, such that the seat back is located on the seat base to position a center of gravity of the child's toy generally centrally over the swing seat. Optionally, when wrapped around the swing seat, the first strap may extend through an opening in the seat back to further hold the seat back in engagement with the selected location on seat base.

In accordance with another aspect of the present invention, a swing attachment apparatus for holding a child's toy on a swing includes a toy seat that has a back portion adjustably attached to a base portion that rests on a swing seat. A swing engagement device, such as an attachment strap, is configured to engage the base portion of the toy seat securely on the swing seat. A harness strap is attached to opposing lateral sides of the base portion and is configured to extend laterally over the child's toy to secure the child's toy between to the toy seat. Optionally, a plurality of adjustment apertures may extend along the lateral sides of the base portion of the toy seat for receiving legs that protrude from a lower portion of the back portion to engage the back portion with the base portion. Also, the harness strap may include a left section that attaches at a left side of the base portion and a right section that attaches at a right side of the base portion, such that the left and right sections of the harness strap adjustably engage together to hold the child's toy securely against the back and base portions of the toy seat.

These and other objects, advantages, purposes and features of the present invention will become apparent upon review of the following specification in conjunction with the drawings.

DESCRIPTION OF THE PREFERRED EMBODIMENTS

Figure 1:
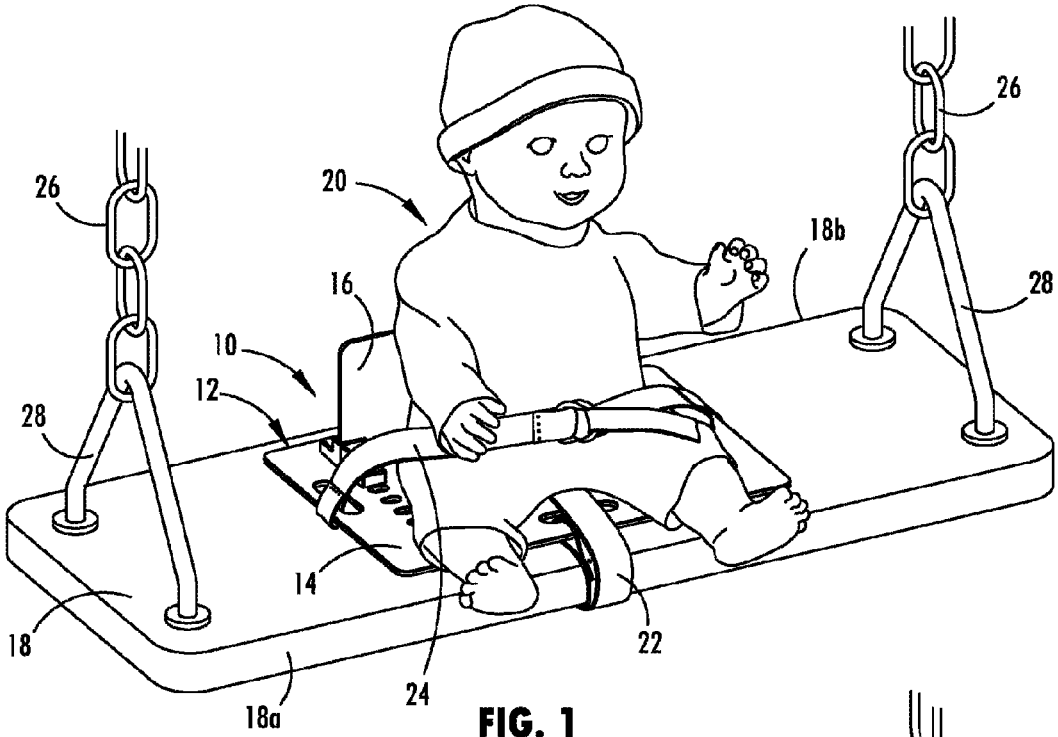
FIG. 1 is an upper perspective view of a swing attachment apparatus attached to a swing and supporting a doll, in accordance with the present invention.
Figure 1A:
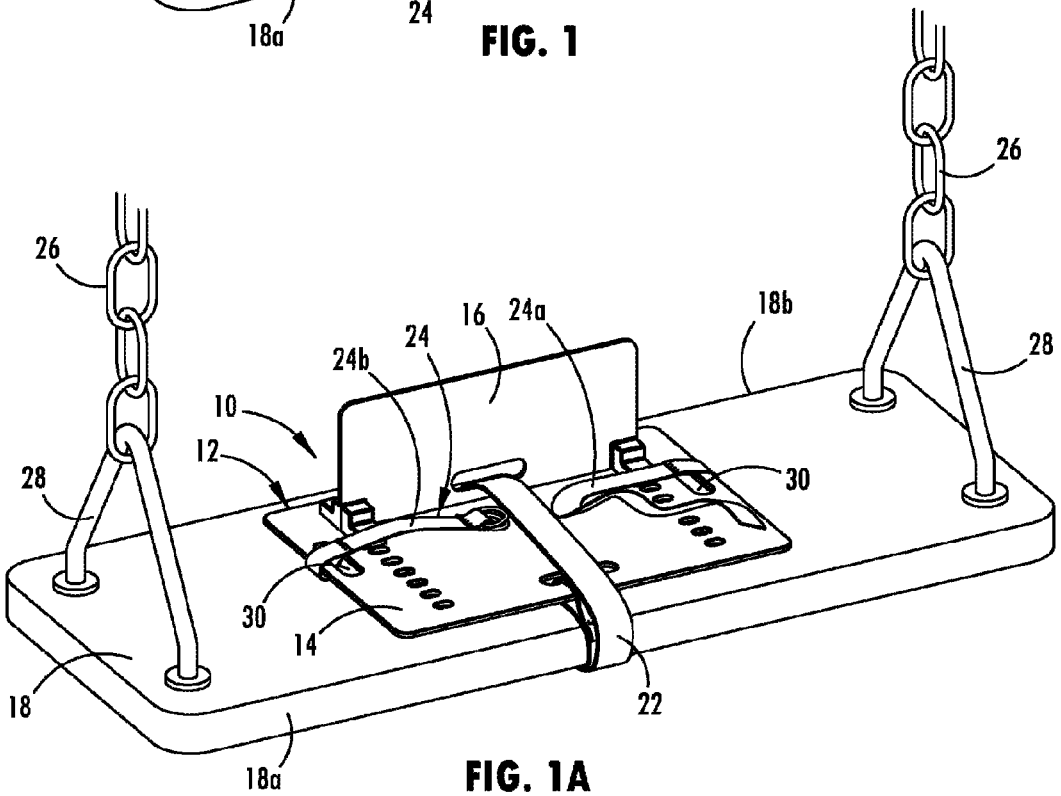
FIG. 1A is an upper perspective view of the swing attachment apparatus shown in FIG. 1 attached to the swing without the doll.
Figure 1B:
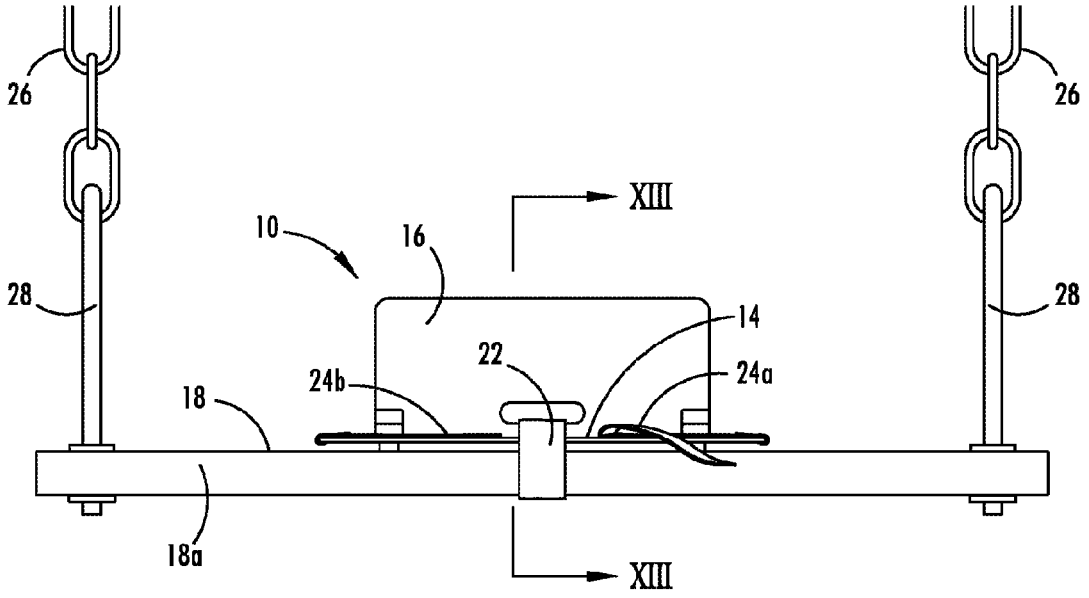
FIG. 1B is a front elevational view of the swing attachment apparatus shown in FIG. 1 attached to the swing without the doll.

Referring now to the drawings and the illustrative embodiments depicted therein, a swing attachment apparatus 10 includes a toy seat 12 that has a seat base 14 and a seat back 16 removably and adjustably attached to the seat base 14. The toy seat 12 is configured for a user, such as a child, to easily attach it to a swing seat 18 for supporting and holding a child's toy 20, such as a doll or stuffed animal or the like. The seat base 14 has a lower portion that is configured to rest on the swing seat 18 and an upper portion configured to receive and support the child's toy 20. The seat base 14 may be configured to secure to a variety of swing seats, such as a rigid seat (FIGS. 1-1C), a flexible seat (FIGS. 2-2C), or a tire, or the like, or other supportive structures or objects, such as to hand railings, fences, or other locations where a child may want to hold or display their toy. The toy seat 12 may be secured to such a swing seat 18 or object with an attachment device 22, such as a strap or belt or fastener or the like. Further, to secure the toy 20 to the toy seat 12, a harness 24 or strap or the like may be attached to the seat base 14 so as to extend over the child's toy 20 to secure the child's toy 20 against the seat base 14.

Figure 1C:
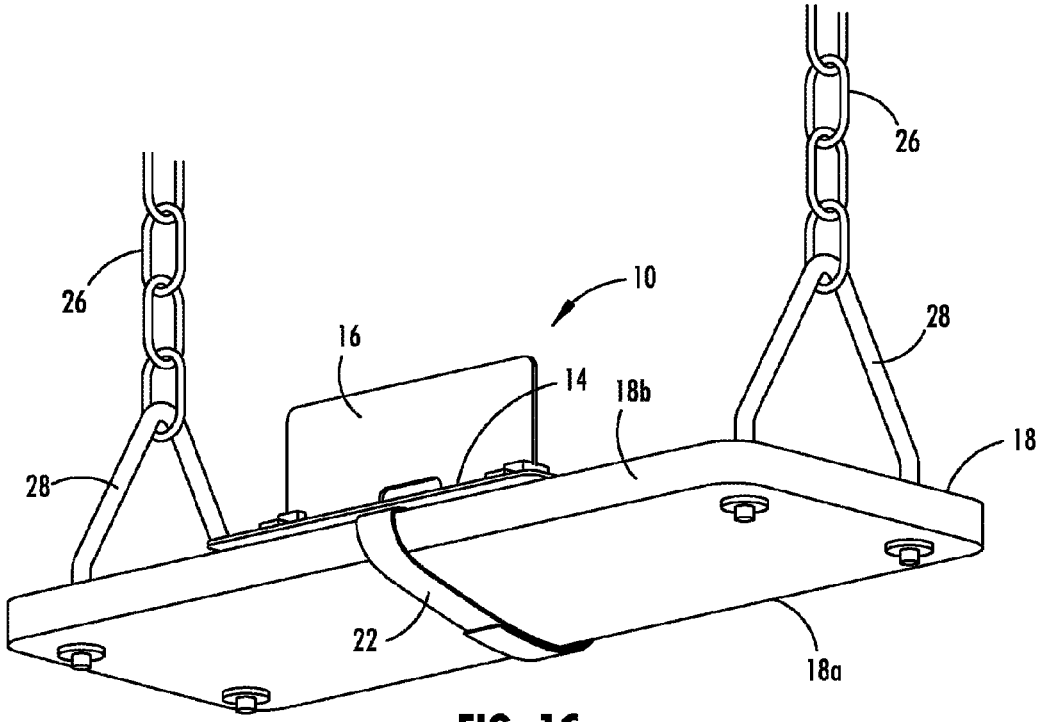
FIG. 1C is a lower perspective view of the swing attachment apparatus shown in FIG. 1 attached to the swing without the doll.
Figure 2:
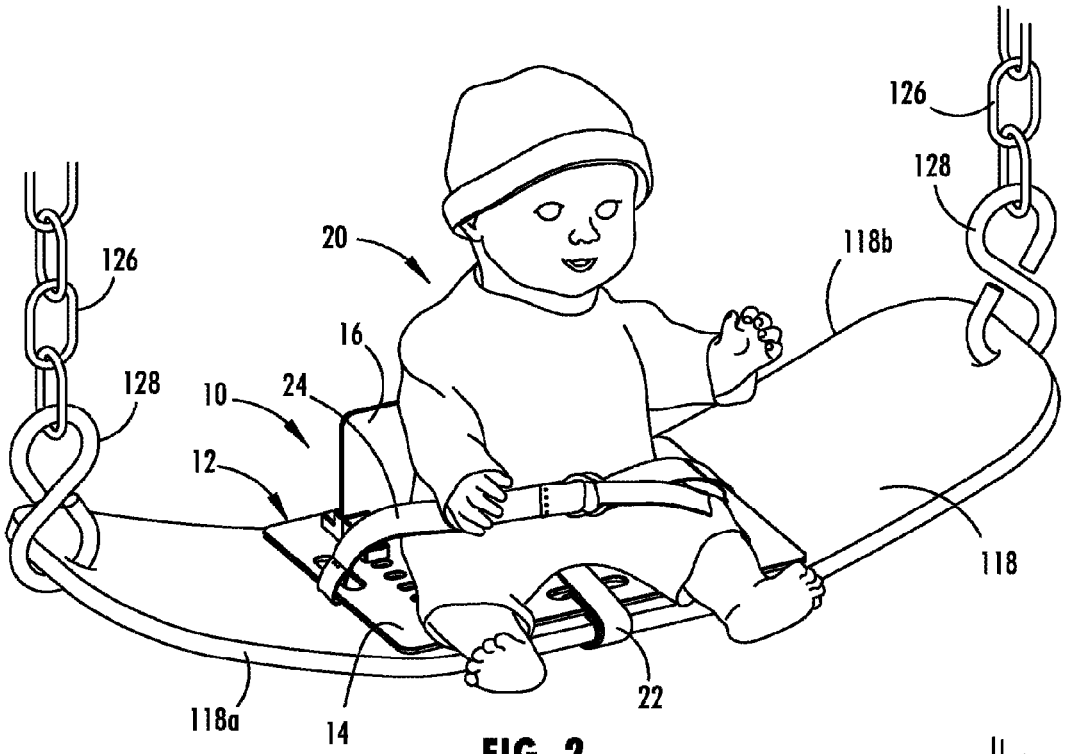
FIG. 2 is an upper perspective view of a swing attachment apparatus supporting a doll and attached to an alternative swing from that shown in FIG. 1.
Figure 2A:
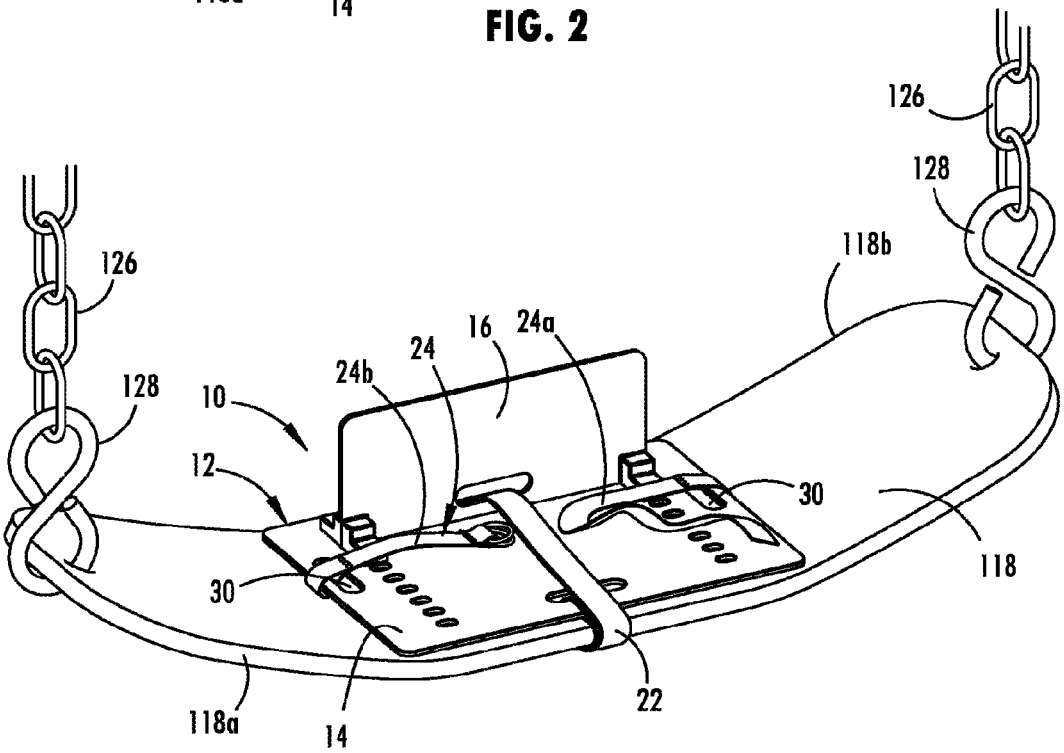
FIG. 2A is an upper perspective view of the swing attachment apparatus shown in FIG. 2 attached to the swing without the doll.
Figure 2B:
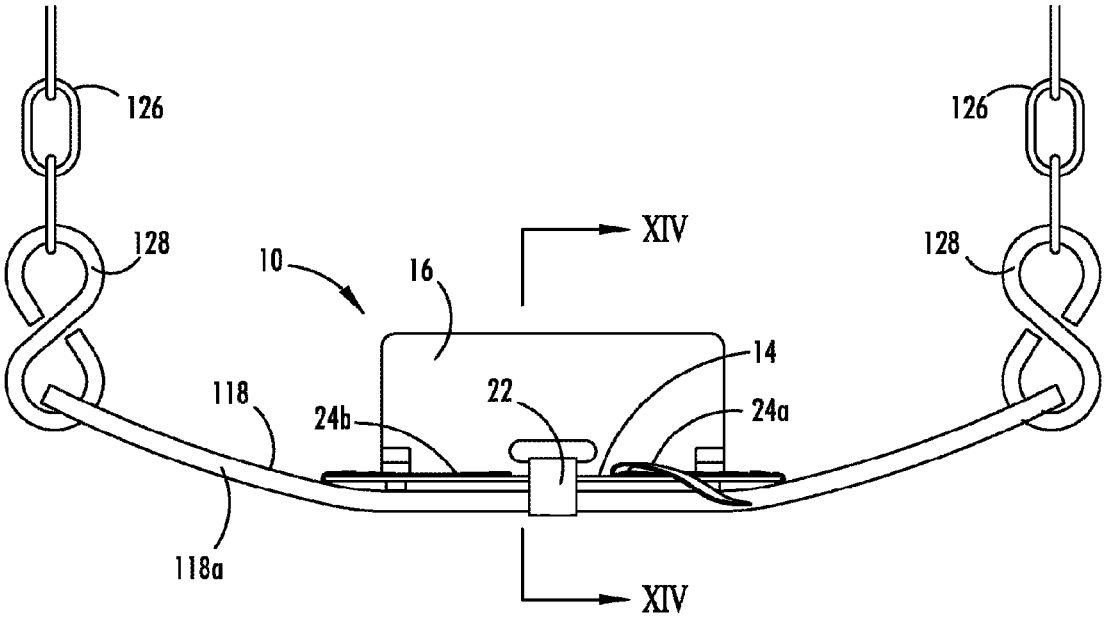
FIG. 2B is a front elevational view of the swing attachment apparatus shown in FIG. 2 attached to the swing without the doll.
Figure 2C:
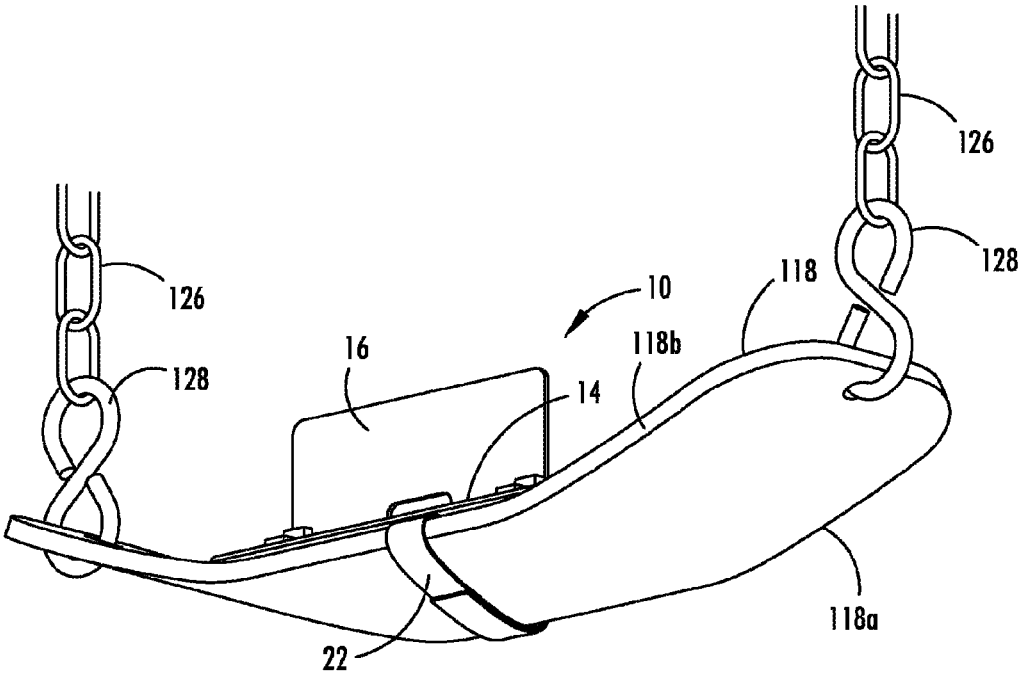
FIG. 2C is a lower perspective view of the swing attachment apparatus shown in FIG. 2 attached to the swing without the doll.
Figure 3:
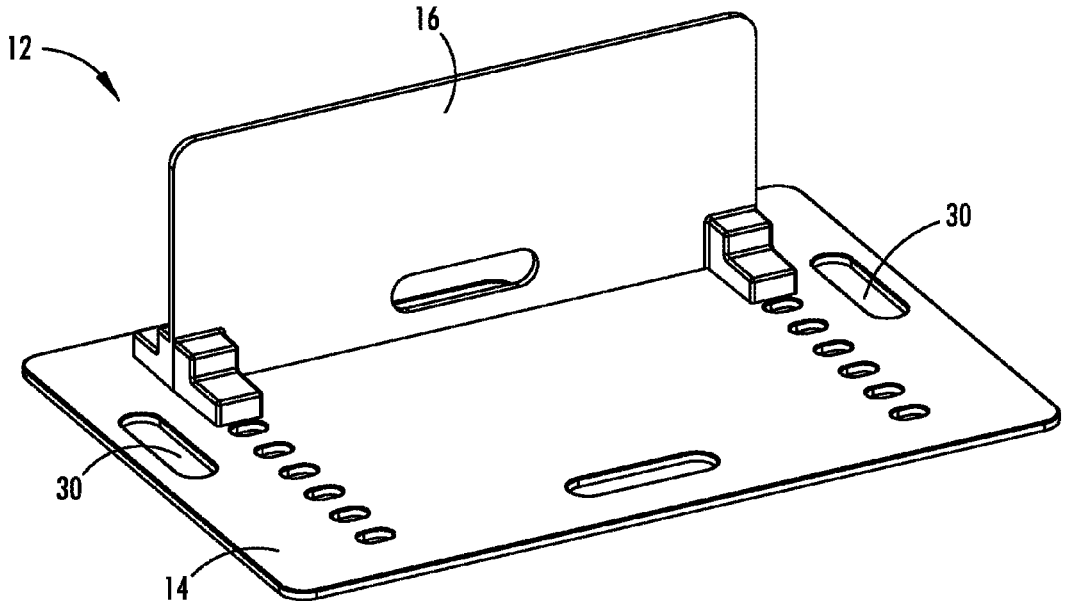
FIG. 3 is an upper perspective view of the swing attachment apparatus shown in FIG. 1, taken from a front of the swing attachment apparatus.
Figure 4:
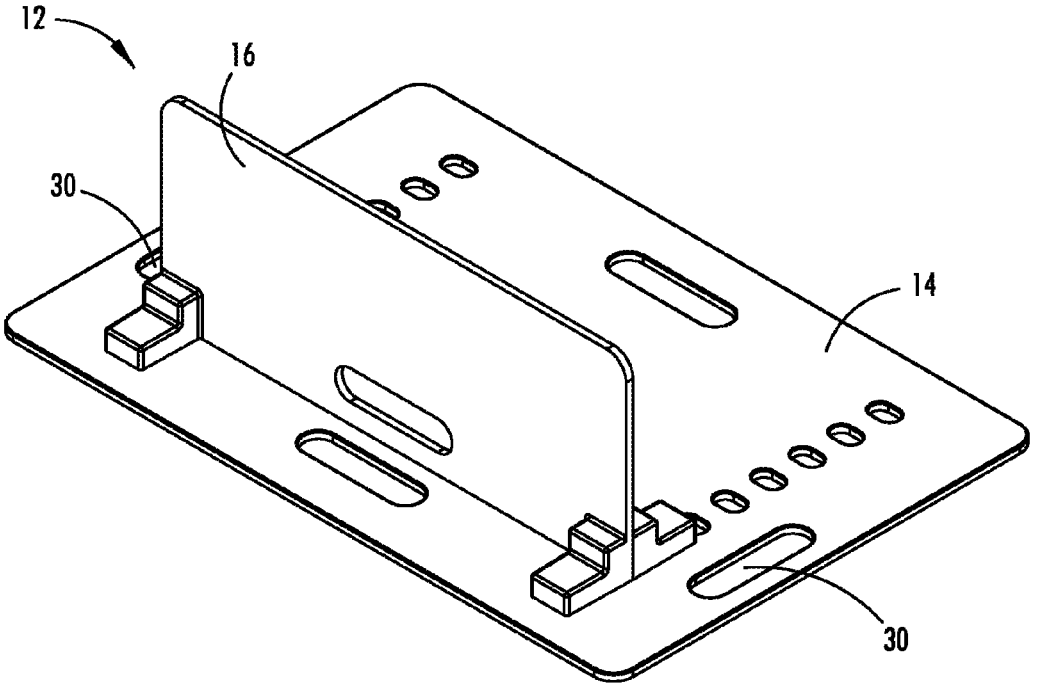
FIG. 4 is an upper perspective view of the swing attachment apparatus shown in FIG. 3, taken from a rear of the swing attachment apparatus.
Figure 5:
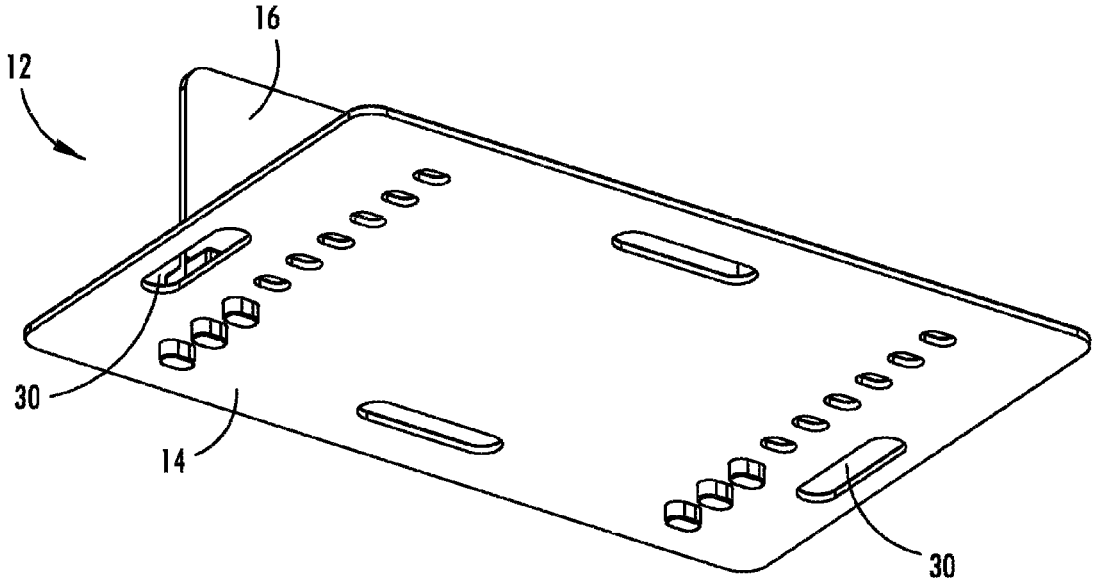
FIG. 5 is an lower perspective view of the swing attachment apparatus shown in FIG. 3, taken from a front of the swing attachment apparatus.
Figure 6:
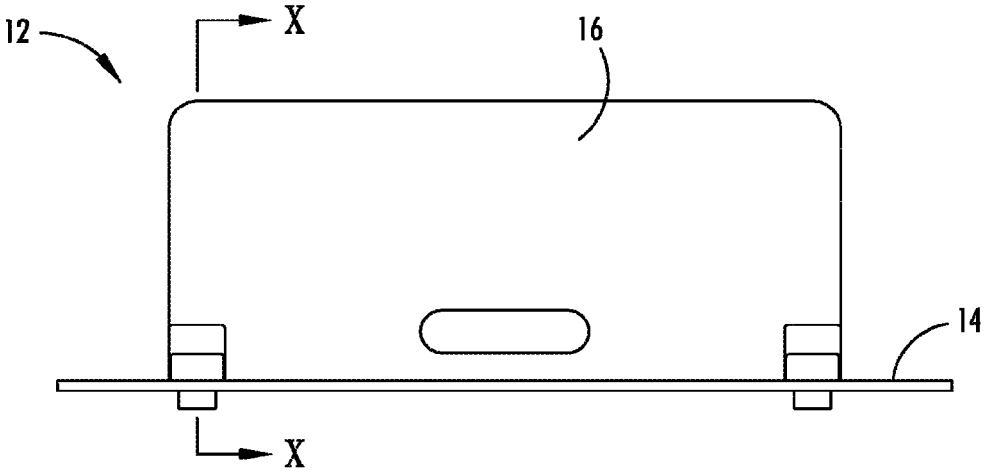
FIG. 6 is a front elevational view of the swing attachment apparatus shown in FIG. 3.
Figure 7:
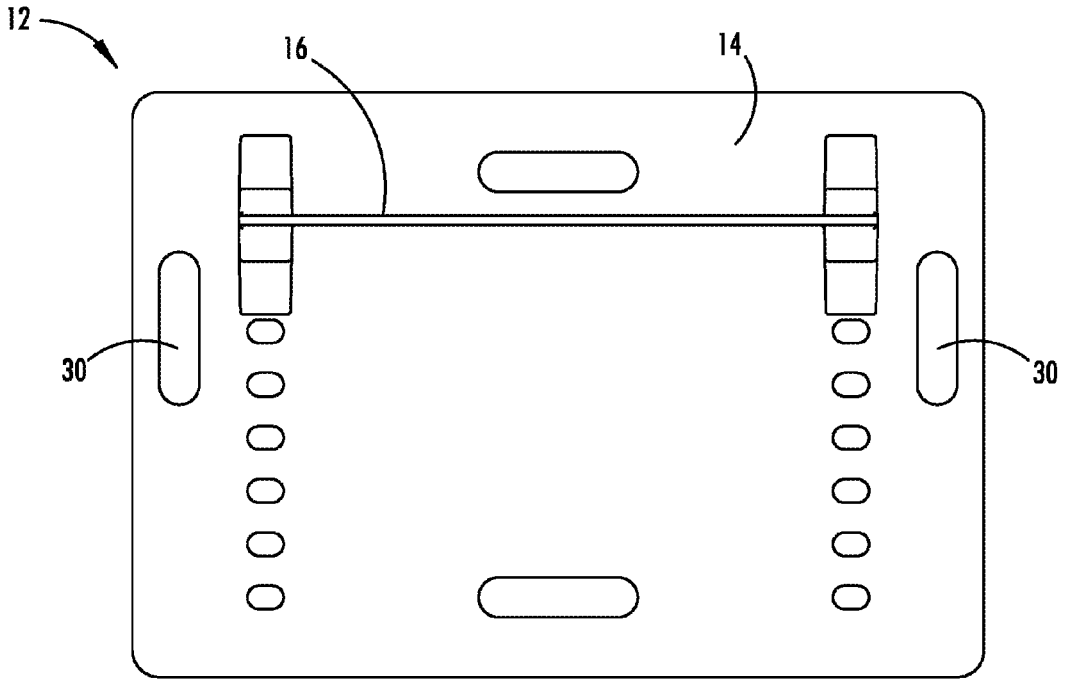
FIG. 7 is a top plan view of the swing attachment apparatus shown in FIG. 3.
Figure 8:
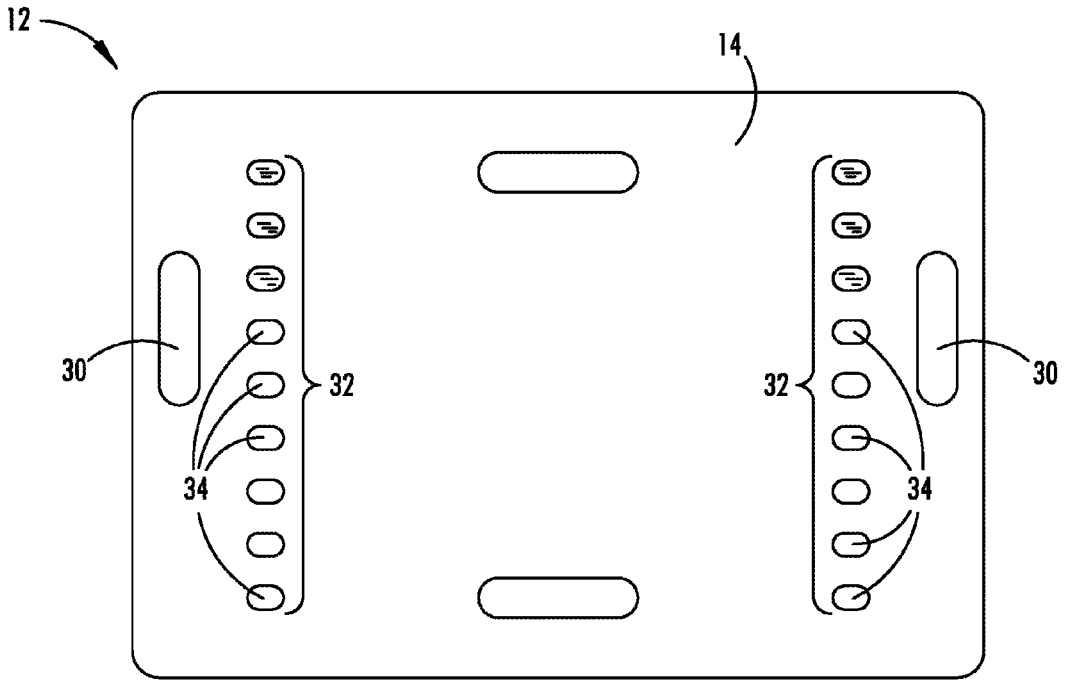
FIG. 8 is a bottom plan view of the swing attachment apparatus shown in FIG. 3.

The illustrated swing attachment apparatus 10, such as shown in FIGS. 1-2C, includes the seat back 16 engaged with the seat base 14 to support a rear portion or back of the child's toy 20. The seat back 16 is adjustably engaged on the seat base 14 in a longitudinal location to position a center of gravity of the child's toy 20 generally centrally over the swing seat 18. The illustrated swing seat 18 in FIGS. 1-1C is supported by two chains 26 that each attach to a V-shaped bracket 28 that is secured on the lateral sides of the swing seat 18. The chains 26 are thereby generally centered between the front edge 18*a* and the rear edge 18*b* of the swing seat 18, such that the chains 26 define a theoretical lever axis that extends centrally across the swing seat between the front and rear edges 18*a*, 18*b*. Similarly, in FIGS. 2-2C the flexible seat 118 is supported by two chains 126 that each attach to the lateral sides of the swing seat 118 via S-shaped hooks 128. The chains 126 are similarly centered between the front edge 118*a* and the rear edge 118*b* of the swing seat 118 to define a theoretical lever axis extending centrally across the swing seat 118 between the front and rear edges 118*a*, 118*b*. Thus, if the toy 20 is placed on the swing seat with the center of gravity forward the lever axis, the swing seat may tip forward and possibly flip over or upside-down due to the unsupported weight of the toy 20. Accordingly, the swing attachment apparatus 10 is configured to be adjustable to position the center of gravity of the child's toy 20 generally centrally over the theoretical lever axis of the swing seat 18, 118 as described in further detail herein.

As further shown in FIGS. 1-2C, the harness 24 or strap is divided into two section, providing a left section 24*a* that attaches at a left side portion of the seat base 14 and a right section 24*b* that attaches at a right side portion of the seat base 14. Specifically, the illustrated seat base 14 includes strap openings 30 positions slightly rearward from the center of the seat base 14, such that the harness strap 24 engages the seat base at or around or adjacent to each of the strap openings 30 and extends over the toy 20, such as the lap of the toy as shown in FIG. 1, to secure the toy downward and rearward against the seat base and seat back 14, 16, respectively. The left and right sections 24*a*, 24*b* of the harness strap 24 adjustably engage to hold the child's toy securely against the seat base. As shown, the right section 24*b* includes a pair of D-rings at the distal end of the strap section and the left section 24*a* is laced through the D-rings in a manner to tightly secure the harness strap 24 over the toy. It is conceivable that various other features may be implemented for adjustably fasten the harness strap, such as plastic clasps, buckles, knots, hook-and-loop fasteners, or other fastening features that may be easily engaged and disengaged by a child. It is also conceivable that the harness strap in additional embodiments may include more or fewer straps, such as a single strap across the seat base or an additional strap or straps between the legs of the toy or over the shoulders of the toy. Optionally, the harness strap may attach directly to or around the swing seat.

The toy seat 12, as shown in FIGS. 3-9, includes the seat back 16 adjustably engaged with the seat base 14 to support the child's toy. The longitudinal adjustability of the seat back 16 relative to the seat base 14 may be provided by a plurality of adjustment features 32 that extend along lateral sides of the seat base 14. The seat back 16 is engaged with a selected set or one of the plurality of adjustment features 32 on each of the lateral sides of the seat base 14 to secure the seat back 16 to the seat base 14. The selected set of the plurality of adjustment features 32 engaged by the seat back 16 is preferably selected to locate the seat back 16 longitudinally on the seat base 14 to position a center of gravity of the child's toy 20 generally centrally over the swing seat 18, 118 (FIGS. 1 and 2). It is conceivable that an alternative adjustment feature may be incorporated between the seat back and seat base, such as a slide configuration or the like.

Figure 9:
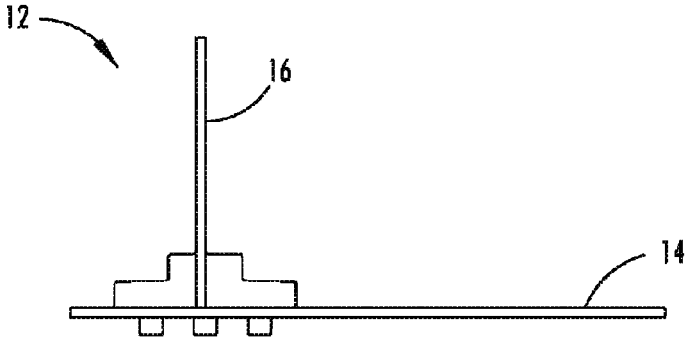
FIG. 9 is a side elevational view of the swing attachment apparatus shown in FIG. 3.
Figure 10:
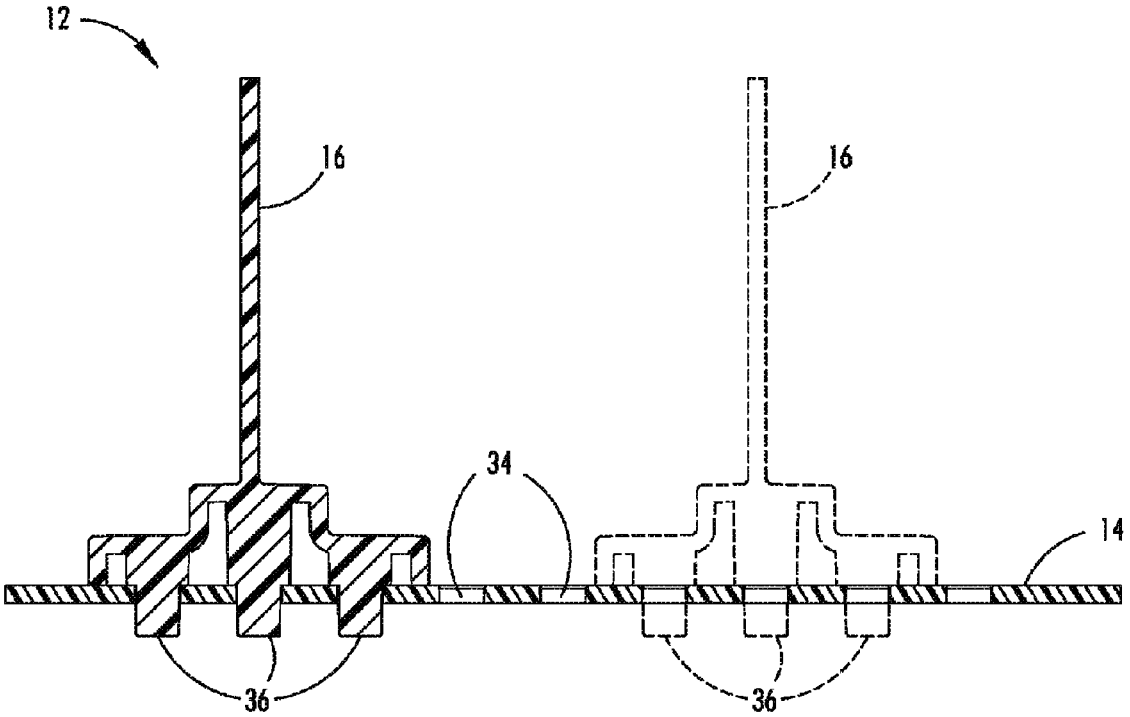
FIG. 10 is a cross-sectional view of the swing attachment apparatus, taken at line X-X shown in FIG. 6.
Figure 11:
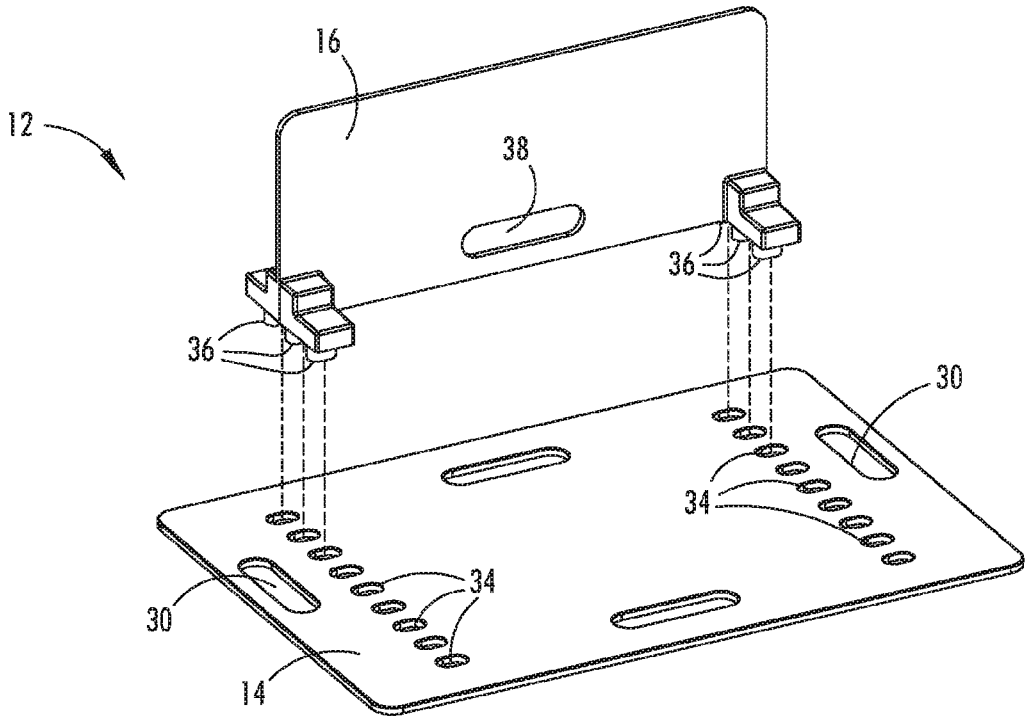
FIG. 11 is an exploded upper perspective view of the swing attachment apparatus shown in FIG. 3.
Figure 12:
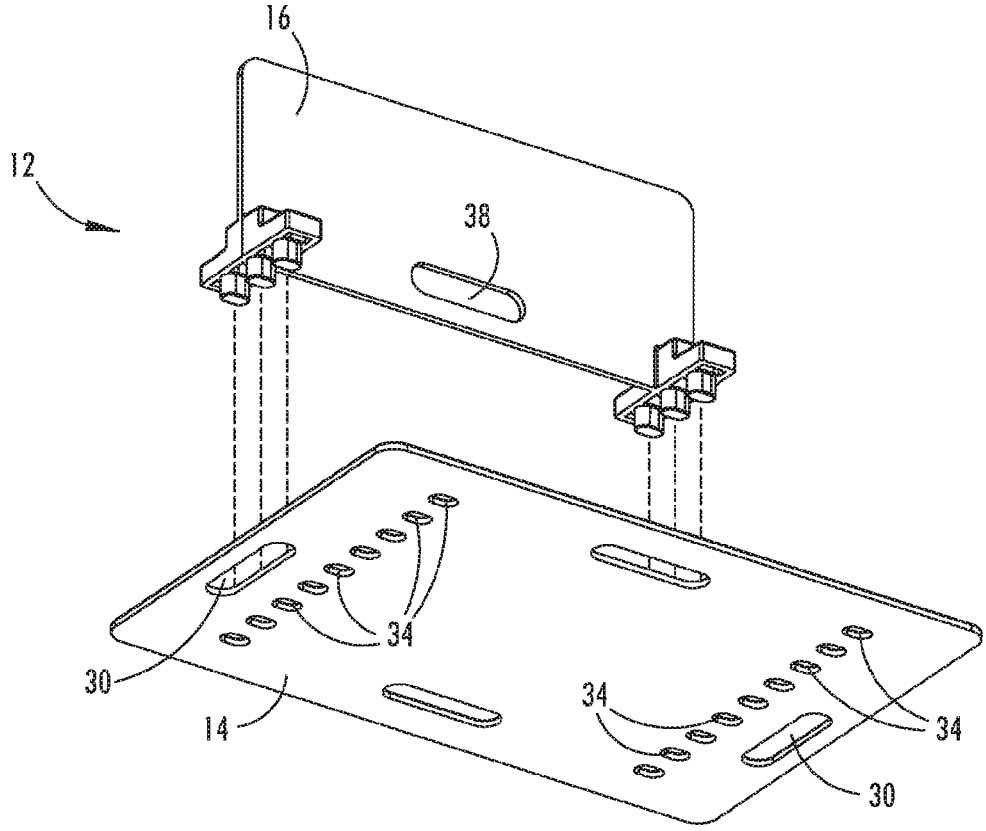
FIG. 12 is an exploded lower perspective view of the swing attachment apparatus shown in FIG. 5.

The plurality of adjustment features 32 shown in FIGS. 3-9 include a row of apertures 34, where each aperture extends generally vertically through the seat base 14 and has an opening with a generally non-circular shape. However, circular shaped opening and angled apertures may be used in additional embodiments. The seat back 16 includes at least one leg 36 that protrudes downward from a lower portion of the seat back 16 on opposing lateral sides of the seat back 16 to engage through one of the apertures 34. As shown in FIGS. 10-12, there are three legs 36 on each side the seat back 16 that extend down from housing blocks that provide structural rigidity to the connection between the legs 36 and the seat base 14, to prevent the legs from easily dislodging from the apertures 34. The legs 36 further have a corresponding cross-sectional shape to fit tightly within the opening of the apertures 34. As shown in FIGS. 9 and 10, the legs 36 extend a distance beyond the seat base 14 through the adjustment apertures 34 to allow the seat base 14 to flex and/or the seat back 16 to have a generally loose or vertically movable connection with the seat base 14. Again, when desired to fit the toy seat 12 to a doll or other child's toy, the legs 36 may be removed vertically upward from the apertures and reengaged in a new position, such as shown in a more forward selected position in dashed lines in FIG. 10. The seat base and back 14, 16 may each comprises a panel of plastic material, where the seat base 14 may be configured to flex to generally conform somewhat to a curvature in an upper surface of the swing seat, such as flexing to conform to the lateral curvature in the flexible swing seat 118 shown in FIGS. 2-2C.

Figure 13:
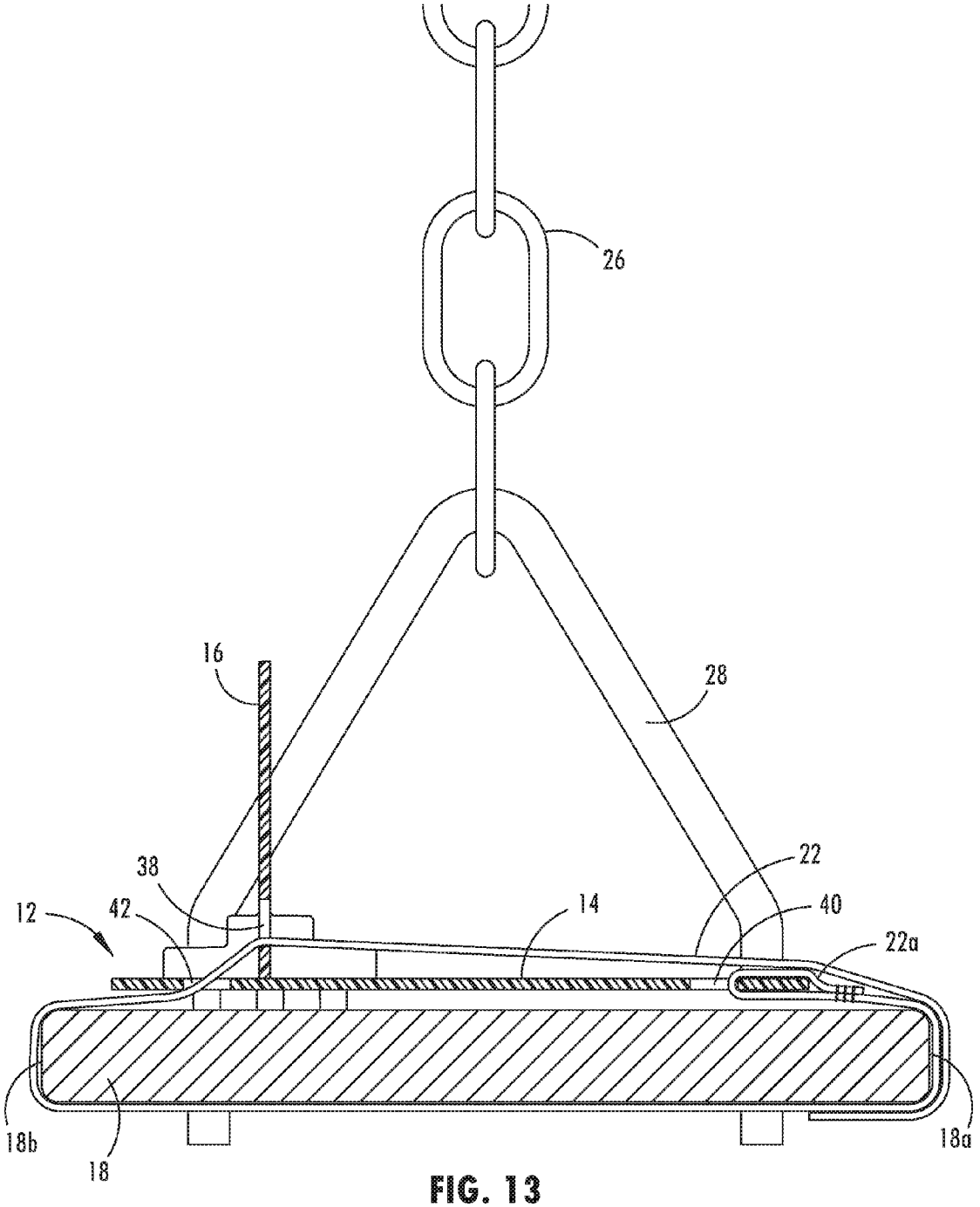
FIG. 13 is a cross-sectional view of the swing attachment apparatus and swing, taken at line XIII-XIII shown in FIG. 1B.
Figure 14:
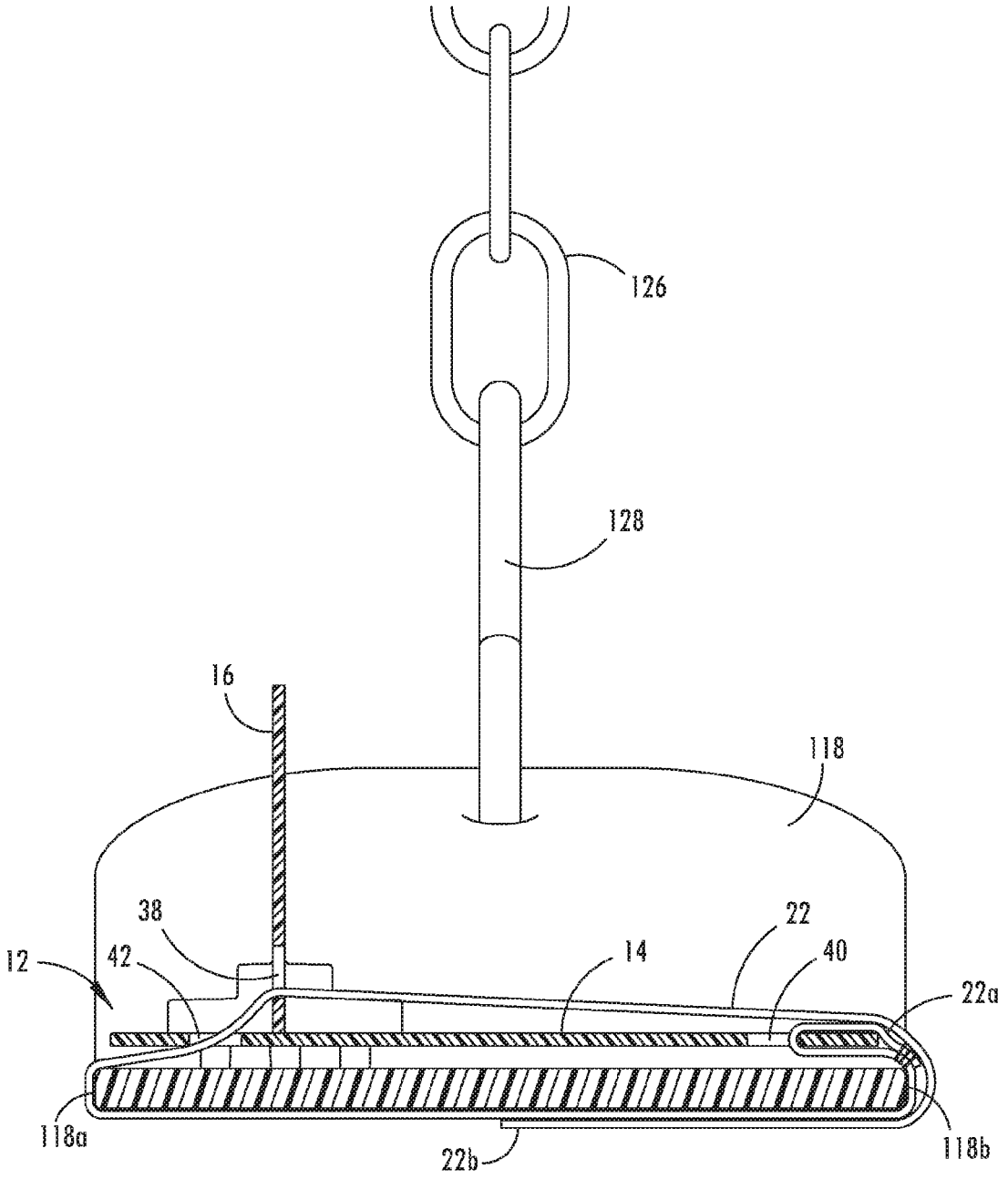
FIG. 14 is a cross-sectional view of the swing attachment apparatus shown in FIG. 13, attached to the flexible swing seat of FIG. 2.

The swing engagement device is shown in FIG. 13 with the attachment strap 22 that is configured to extend through an opening 38 in the seat back 16 (FIG. 1) of the toy seat 12 and wrap around the swing seat 18. Thus, the attachment strap 22 holds both the seat back 16 down in engagement with the seat base 14 and the toy seat 12 in secure attachment or engagement to the swing seat 18. As shown in FIG. 13, one end 22*a* of the attachment strap 22 is sewn around a front edge 18*a* of the seat base 14, extending through a forward opening 40. The strap 22 is then wrapped under the swing seat 18 and extended rearward and up around the rear edge of the swing seat 18*b* and under the seat base 14 and through the rear opening 42. Once through the rear opening 42, the strap 22 is passed through the opening 38 in the seat back 16 and forward over for the distal end 22*b* of the strap 22 to attach to the strap at or near the front edge 18*a* of the swing seat 18. The connection between the outer surface of the strap and the distal end 22*b* of the strap 22 may be secured by a hook-and-loop fastener (i.e. Velcro) configured to secure the attachment strap in a wrapped configuration to hold the toy seat 12 to the swing seat. The attachment strap 22 is also shown in FIG. 14 wrapped in a similar manner and tightened around the thinner flexible swing seat 118, where the distal end 22*b* of the strap 22 attaches under the swing seat 118. As such, the attachment strap 22 (FIGS. 13 and 14) may be loosely connected, such as done by a child, while not allowing the legs 36 to disengage from the adjustment apertures 34 due to the portion of the legs 36 extending a distance beyond the seat base 14 to allow the seat back 16 to have a generally loose or vertically movable connection with the seat base 14.

The seat back may be removably and/or adjustably attached to the seat base to allow the seat back to be positioned relative to seat base in a manner that adjusts the seating area to accommodate toys of different sizes and shapes. Such adjustment of the seat back may also allow the toy to be positioned on the seat base in a location that generally centers the toy's center of gravity over the swing seat, such that the toy remains generally upright and does not flip over or upside-down due to the unsupported weight of the toy, when secured to the swing attachment apparatus. The toy seat and toy may be secured to the swing seat with attachment devices, such as straps or belts or the like, that secure the toy in a manner that generally allows a child to swing and play with the toy without it being dislodged. The seat base and seat back may preferably be made of thin durable plastic material and the straps may preferably be made using nylon material or the like.

Changes and modifications in the specifically-described embodiments may be carried out without departing from the principles of the present invention, which is intended to be limited only by the scope of the appended claims as interpreted according to the principles of patent law including the doctrine of equivalents.

The invention claimed is:

1. A swing attachment apparatus for holding a child's toy on a swing, said swing attachment apparatus comprising:

a seat base having a lower portion configured to rest on a swing seat and an upper portion configured to support a child's toy;

a first strap attached to the seat base and configured to wrap around the swing seat to secure the seat base to the swing;

a second strap attached to the seat base and configured to extend over the child's toy to secure the child's toy between the second strap and the seat base; and a seat back adjustably engaged with the seat base and configured to support a rear portion of the child's toy.

2. The swing attachment apparatus of claim 1, wherein the seat back is adjustable relative to the seat base to a selected position that is configured to generally center the child's toy on the swing seat.

3. The swing attachment apparatus of claim 1, wherein the seat back includes an opening, and wherein, when wrapped around the swing seat, the first strap is configured to extend through the opening in the seat back to secure the seat back to the seat base.

4. The swing attachment apparatus of claim 1, wherein the seat base includes a plurality of adjustment features extending along lateral sides of the seat base, and wherein the seat back is engaged with at least one of the plurality of adjustment features on each of the lateral sides of the seat base to secure the seat back to the seat base.

5. The swing attachment apparatus of claim 4, wherein the seat back is configured to be engaged with a selected set of the plurality of adjustment features that locates the seat back longitudinally on the seat base to position a center of gravity of the child's toy generally centrally over the swing seat.

6. The swing attachment apparatus of claim 4, wherein the plurality of adjustment features comprises a row of apertures that each extend generally vertically through the seat base, and wherein the seat back includes at least one leg on opposing lateral sides of the seat back that are configured to engage through one of the row of apertures.

7. The swing attachment apparatus of claim 1, wherein the second strap includes a left section that attaches at a left side portion of the seat base and a right section that attaches at a right side portion of the seat base, and wherein the left and right sections of the second strap adjustably engage hold the child's toy securely against the seat base.

8. The swing attachment apparatus of claim 1, wherein the seat base comprises a panel of plastic material that is configured to flex to generally conform to a curvature in an upper surface of the swing seat.

9. A swing attachment apparatus for holding a child's toy on a swing, said swing attachment apparatus comprising:

a toy seat having a back portion adjustably attached to a base portion that is configured to rest on a swing seat;

a swing engagement device configured to engage the base portion of the toy seat securely on the swing seat; and a harness strap attached to opposing lateral sides of the base portion and configured to extend laterally over the child's toy to secure the child's toy between to the toy seat.

10. The swing attachment apparatus of claim 9, wherein the swing engagement device comprises an attachment strap that is configured to extend through an opening in the back portion of the toy seat and wrap around the swing seat to hold the back portion in engagement with the base portion.

11. The swing attachment apparatus of claim 9, wherein a plurality of adjustment apertures extend along the lateral sides of the base portion of the toy seat for receiving legs that protrude from a lower portion of the back portion to engage the back portion with the base portion.

12. The swing attachment apparatus of claim 11, wherein the plurality of adjustment apertures each include an opening having a non-circular shape.

13. The swing attachment apparatus of claim 9, wherein the back portion is configured to engaged the seat base at a selected longitudinal location to position a center of gravity of the child's toy generally centrally over the swing seat.

14. The swing attachment apparatus of claim 9, wherein the harness strap includes a left section that attaches at a left side of the base portion and a right section that attaches at a right side of the base portion, and wherein the left and right sections of the harness strap adjustably engage together to hold the child's toy securely against the back and base portions of the toy seat.

15. The swing attachment apparatus of claim 14, wherein the swing engagement device comprises an attachment strap that is configured to extend through an opening in the back portion of the toy seat and wrap around the swing seat, and wherein the attachment strap includes a hook-and-loop fastener configured to secure the attachment strap in a wrapped configuration holding the toy seat to the swing seat.

16. The swing attachment apparatus of claim 9, wherein the base portion of the swing seat comprises a panel of plastic material that is configured to flex to generally conform to a curvature in an upper surface of the swing seat.

17. A swing attachment apparatus for holding a child's toy on a swing, said swing attachment apparatus comprising:

a seat base having a lower portion configured to rest on a swing seat and an upper portion configured to support a child's toy;

a first strap attached to the seat base and configured to wrap around the swing seat to secure the seat base to the swing;

a second strap attached to the seat base and configured to extend over the child's toy to secure the child's toy between the second strap and the seat base, wherein the seat base comprises a panel of plastic material that is configured to flex to generally conform to a curvature in an upper surface of the swing seat; and a seat back removably engaged with the seat base.

18. The swing attachment apparatus of claim 17, further comprising the seat back adjustably engaged with the seat base and configured to support a rear portion of the child's toy.

19. The swing attachment apparatus of claim 18, wherein the seat back is adjustable relative to the seat base to a selected position that is configured to generally center the child's toy on the swing seat.

20. The swing attachment apparatus of claim 17, wherein the seat base includes a plurality of adjustment features extending along lateral sides of the seat base, and wherein the seat back is engaged with at least one of the plurality of adjustment features on each of the lateral sides of the seat base to secure the seat back to the seat base.

* * * * *